US005529391A

United States Patent [19]

Kindman et al.

[11] Patent Number: 5,529,391

[45] Date of Patent: Jun. 25, 1996

[54] MAGNETIC STIRRING AND HEATING/COOLING APPARATUS

[75] Inventors: L. Allen Kindman; Ronald F. Overaker, both of Durham; Brian C. Dodge, Hillsborough, all of N.C.

[73] Assignee: Duke University, Durham, N.C.

[21] Appl. No.: 310,569

[22] Filed: Sep. 22, 1994

[51] Int. Cl.[6] ..... B01F 13/08; B01F 15/06

[52] U.S. Cl. ..... 366/145; 366/146; 366/274

[58] Field of Search ..... 366/144–146, 366/149, 273, 274; 416/3; 310/46, 48; 210/222; 422/99, 224, 225

[56] References Cited

U.S. PATENT DOCUMENTS

| | | | |
|---|---|---|---|
| 3,333,829 | 8/1967 | Moore et al. | 366/145 |
| 3,356,346 | 12/1967 | Landsberger | 366/274 |
| 3,784,170 | 1/1974 | Petersen et al. . | |
| 3,866,669 | 2/1975 | Gardiner | 366/145 X |
| 4,080,663 | 3/1978 | Wik | 366/274 |
| 4,199,265 | 4/1980 | Sanderson et al. | 366/274 |
| 4,477,192 | 10/1984 | Bonney | 366/274 |
| 4,568,195 | 2/1986 | Herz et al. | 366/274 |
| 4,752,138 | 6/1988 | Rufer | 366/274 |
| 4,759,635 | 7/1988 | MacMichael et al. | 366/274 |
| 4,830,511 | 5/1989 | Smazik | 366/273 |
| 4,876,069 | 10/1989 | Jochimsen . | |
| 4,911,555 | 3/1990 | Saffer et al. | 366/274 |
| 4,991,973 | 2/1991 | Maaz et al. | 366/141 |

FOREIGN PATENT DOCUMENTS

| | | | |
|---|---|---|---|
| 3344754 | 6/1985 | Germany | 366/273 |
| 801863 | 2/1981 | U.S.S.R. | 366/273 |
| 2082929 | 3/1982 | United Kingdom | 366/274 |

*Primary Examiner*—Charles E. Cooley
*Attorney, Agent, or Firm*—Richard E. Jenkins

[57] ABSTRACT

A magnetic stirring device which also provides for simultaneous heating/cooling of samples. The magnetic stirring apparatus comprises a plurality of wells into which respective vessels can be placed and continuously stirred by motivating a magnetic stirring bar therein with a three phase frequency controller. Simultaneously, the temperature of the vessels can be maintained at a predetermined temperature either above or below room temperature by means of thermoelectric elements in contact with a heat conducting block within which the wells are located.

17 Claims, 8 Drawing Sheets

MAGNETIC STIRRING AND HEATING/COOLING APPARATUS

GOVERNMENT INTEREST

This invention was made with Government support under Grant 5K11-HLO2361 awarded by the National Institute of Health (NIH). The Government has certain rights therein.

TECHNICAL FIELD

The present invention relates to a magnetic stirring and heating/cooling apparatus, and more particularly to a device providing for simultaneous stirring and thermostating of a plurality of biological samples for use in optical spectroscopy and other applications requiring precise temperature control accompanied by continuous stirring.

RELATED ART

Magnetic stirring apparatus were discovered some years ago and are now well known in the art. For example, U.S. Pat. No. 4,199,265 to Sanderson et al. discloses a motorless magnetic stirrer wherein the stirring bar is motivated by a stepping magnetic field. A plurality of coils are arranged in a circle and generate cyclically recurring pulses so that a magnetic stirring rod located in a container within the magnetic field follows the stepping of the magnetic field. Herz et al. U.S. Pat. No. 4,568,195 also discloses a motorless magnetic stirring apparatus that utilizes a stepping magnetic field to motivate a stirring bar. The apparatus comprises a base which includes a plurality of magnetic coils and onto which a plurality of vessels or receptacles such as Erlenmeyer flasks may be placed. The plurality of vessels positioned on the magnetic coils each contain a magnetic stirring bar which is caused to rotate by the stepping magnetic field created by the magnetic coils therebeneath.

Other patents of interest which disclose magnetic stirrers include U.S. Pat. No. 4,876,069 to Jochimsen; U.S. Pat. No. 3,784,170 to Petersen et al.; U.S. Pat. No. 4,991,973 to Maaz et al.; U.S. Pat. No. 4,752,138 to Rufer; U.S. Pat. No. 4,759,635 to MacMichael et al.; and U.S. Pat. No. 4,830,551 to Smazik. However, none of the references disclose applicants' novel inventive apparatus which provides for the simultaneous stirring of a plurality of samples in optical cuvettes, microcentrifuge tubes or the like but also for the simultaneous thermostatic temperature controlling of the samples during stirring.

Thus, applicants' invention provides a novel apparatus adapted to provide thermostatic temperature control to a plurality of biological specimens while simultaneously magnetically stirring the plurality of specimens. The vessels used to contain the specimens may be optical cuvettes, microcentrifuge tubes or any other type of vessel wherein the sample is required to be simultaneously stirred and thermostatically temperature controlled for subsequent analysis by optical spectroscopy or any other type of analysis requiring samples subjected to precise temperature control accompanied by continuous stirring.

DISCLOSURE OF THE INVENTION

In accordance with the present invention, applicants provide a magnetic stirring and heating/cooling apparatus providing for the simultaneous stirring and precise temperature control of a plurality of biological samples. Applicants contemplate that the apparatus will accommodate samples of one milliliter (ml) to four milliliters (ml) in size and provide simultaneous stirring and thermostatic temperature control thereof at between 0° C. to 40° C. and 0 RPM to 200 RPM, respectively.

The apparatus comprises a plurality of wells for supporting a corresponding plurality of vessels containing magnetic stir bars therein. Power means is provided for generating a plurality of continuously varying currents wherein the currents are in phase shifted relationship relative to each other, and coil means are electrically connected to the power means and operatively associated with each of the plurality of wells for establishing rotating magnetic fields therein in response to the continuously varying currents to motivate the stir bars in the vessels. Heating/cooling means are operatively associated with the plurality of wells for heating/cooling the wells and the plurality of vessels supported therein, and temperature control means are electrically connected to the heating/cooling means for providing thermostatic temperature control to the vessels supported within the wells. Thus, the apparatus is adapted to provide simultaneous thermostatic heating/cooling and stirring of the plurality of liquid samples contained within the plurality of vessels positioned within the corresponding plurality of wells of the apparatus.

It is therefore an object of the present invention to provide an apparatus for simultaneously magnetically stirring and thermostating a plurality of liquid samples.

It is another object of the present invention to provide an apparatus for continuously stirring a plurality of biological samples while providing simultaneous thermostatic temperature control to the samples at a predetermined temperature either above or below room temperature.

It is another object of the present invention to provide an apparatus for simultaneously magnetically stirring and thermostating a plurality of biological samples at a stirring rate between 0 RPM and 200 RPM and at a temperature range between 0° C. and 40° C.

It is another object of the present invention to simultaneously magnetically stir and thermostat a plurality of biological samples in optical cuvettes for subsequent analysis by optical spectroscopy or any other type of analysis requiring samples having been subjected to precise temperature control accompanied by continuous stirring.

It is still another object of the present invention to provide a relatively small and compact apparatus for simultaneously magnetically stirring and thermostating a plurality of biological samples in a plurality of vessels for analysis by optical spectroscopy or any other type of analysis requiring precise temperature control and stirring of a plurality of biological samples.

Some of the objects of the invention having been stated, other objects will become evident as the detailed description proceeds, when taken in connection with the accompanying drawings described hereinbelow.

BEST MODE FOR CARRYING OUT THE INVENTION

Figure 1:
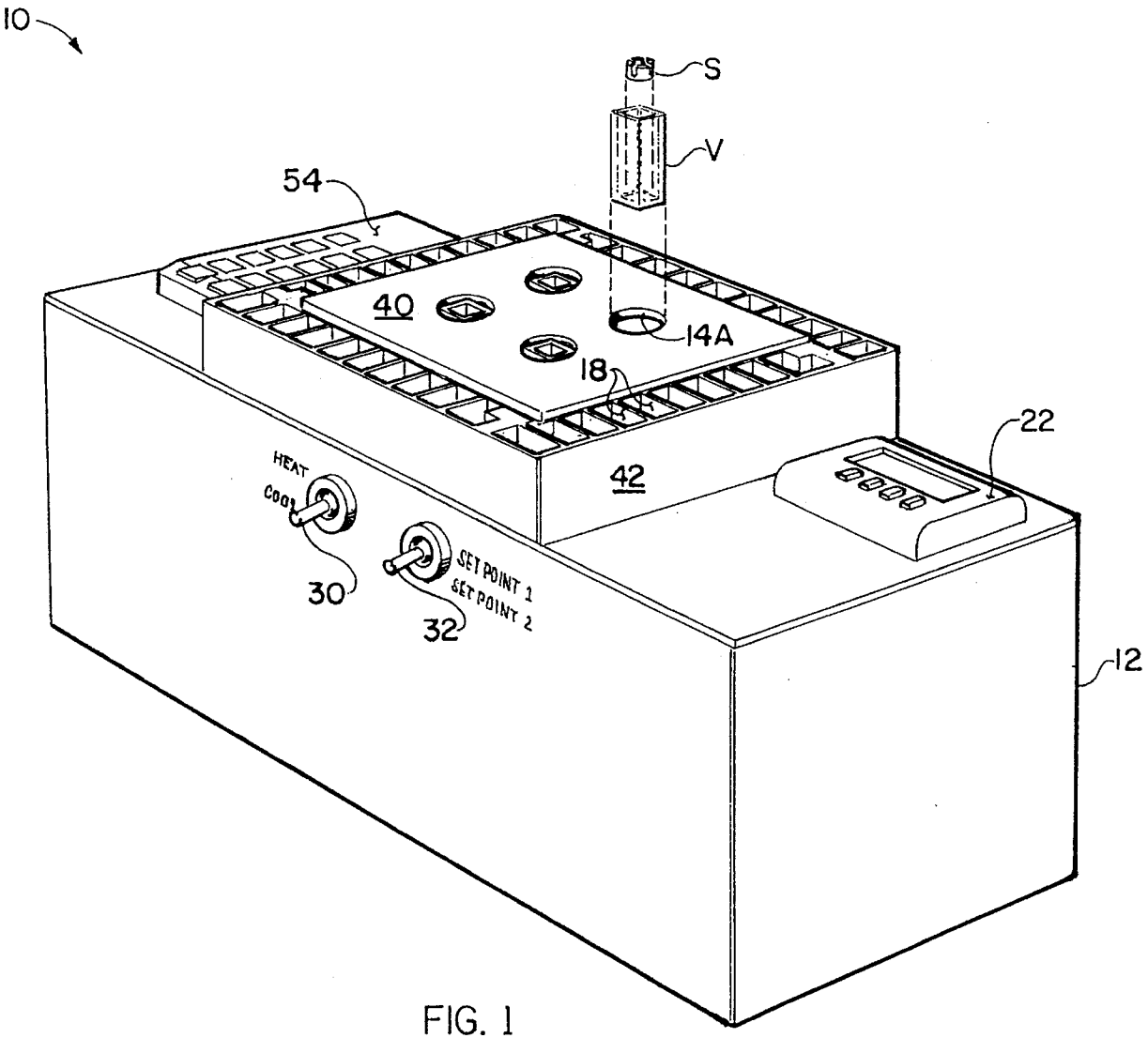
FIG. 1 is a perspective view of an exemplary magnetic stirring and thermostating apparatus in accordance with the present invention.

Referring now to FIGS. 1–7 of the drawings, the simultaneous magnetic stirring and heating/cooling apparatus of the invention is shown and generally designated 10. Stirring and heating/cooling apparatus 10 comprises a housing 12 which contains a heat conductive aluminum block 14 (see particularly FIGS. 2–4) defining four individual wells 14A therein. Wells 14A may be any suitable size to accommodate an optical cuvette, test tube, microcentrifuge tube or the like, and wells 14A in apparatus 10 are eighteen millimeter (mm) diameter holes which have been drilled into aluminum block 14. Thermoelectric elements 16 are secured to each of the four sides of aluminum block 14 so as to heat aluminum block 14 above ambient temperature or to cool aluminum block 14 below ambient temperature, as desired. Thermoelectric elements 16 are most suitably MELCOR Part No. CP2-49-10L. Metal fins 18 be are secured to the outside surface of thermoelectric elements 16 to facilitate dissipation of heat from thermoelectric elements 16 be as air is pulled therethrough by fan 20.

A temperature controller 22, most suitably an Omega Part No. CN9111A, is in electrical connection with thermoelectric elements 16 and a suitable power supply 24, preferably an ELPAC Part No. OFF500-24. Power supply 24 acts to reduce the 110 volt alternating current provided thereto to 24.6 volts of direct current which is in turn provided to the four thermoelectric elements 16. A temperature sensing probe 26, most suitably an OMEGA brand RTD Sensor Part No. F3102, is electrically connected to temperature control 22 so as to facilitate maintaining aluminum block 14 (and the liquid samples located in vessels therein) at a constant predetermined temperature either above or below the ambient temperature, and most preferably in the temperature range of 0° C. to 40° C.

Also included in the temperature control circuit of apparatus 10 (see FIG. 6) are heat/cool switch 30 (which is a double pole double throw/center off switch) for selecting heating or cooling of block 14 and switch 32 (which is a single pole double throw switch) for selecting either temperature set point 1 or temperature set point 2 which have been programmed into temperature controller 22. Further provided in the heating/cooling circuit of apparatus 10 are relays 34 and 36 (see FIGS. 2 and 6). Control relay 34 acts to activate and deactivate thermoelectric elements 16 and reversing relay 36 acts to allow thermoelectric elements 16 to either heat or cool aluminum block 16 to the predetermined temperature set on temperature controller 22. Control relay 34 and reversing relay 36 are most suitably double pole double throw POTTER AND BRUMFIELD Part No. KA-14AG-120 relays, although other relays could be used as a matter of design choice. As with respect to relays 34 and 36, components other than those preferred for use by applicants and described herein can be utilized as a matter of design choice in constructing apparatus 10.

Figure 2:
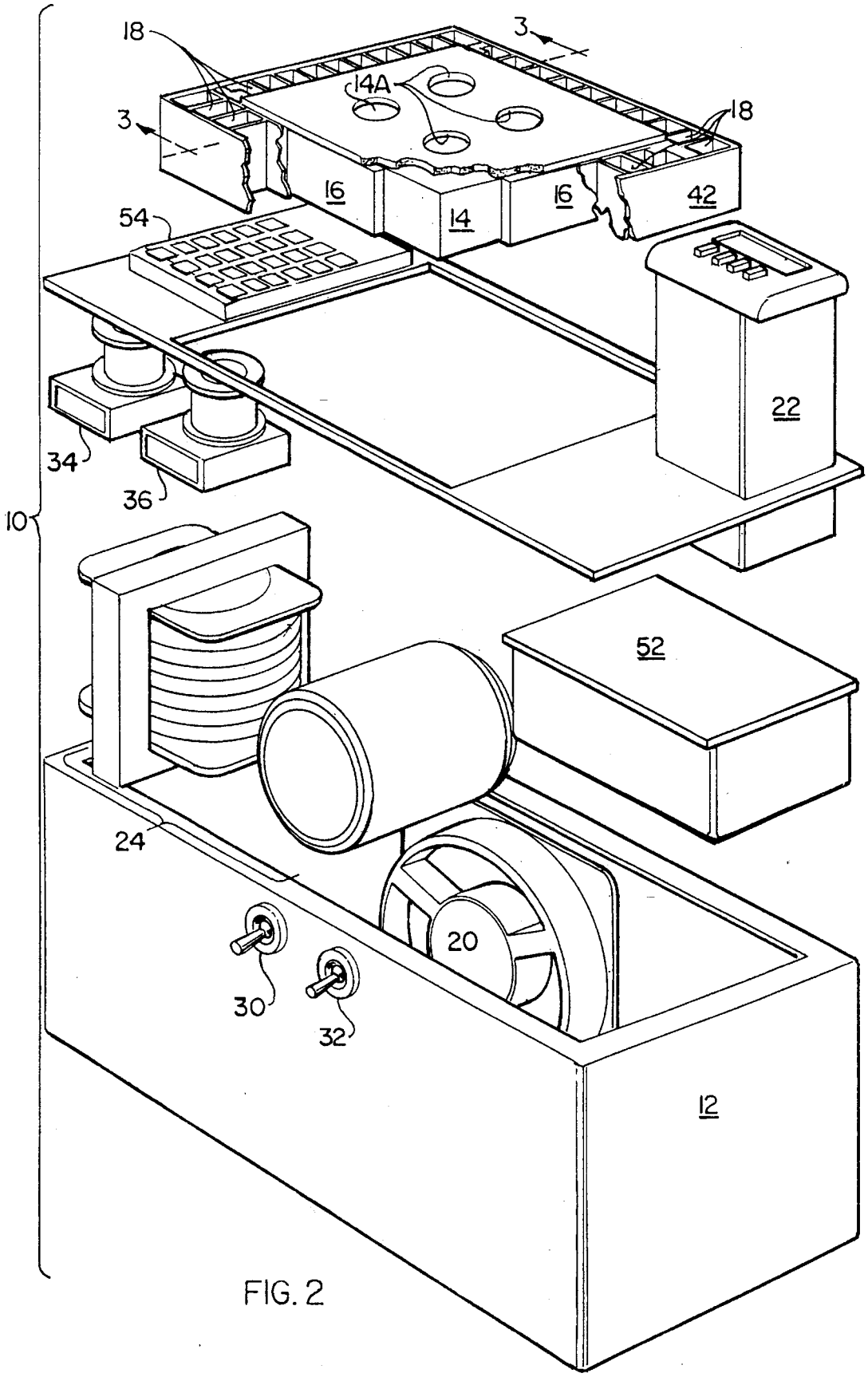
FIG. 2 is an exploded perspective view of the apparatus shown in FIG. 1.
Figure 3:
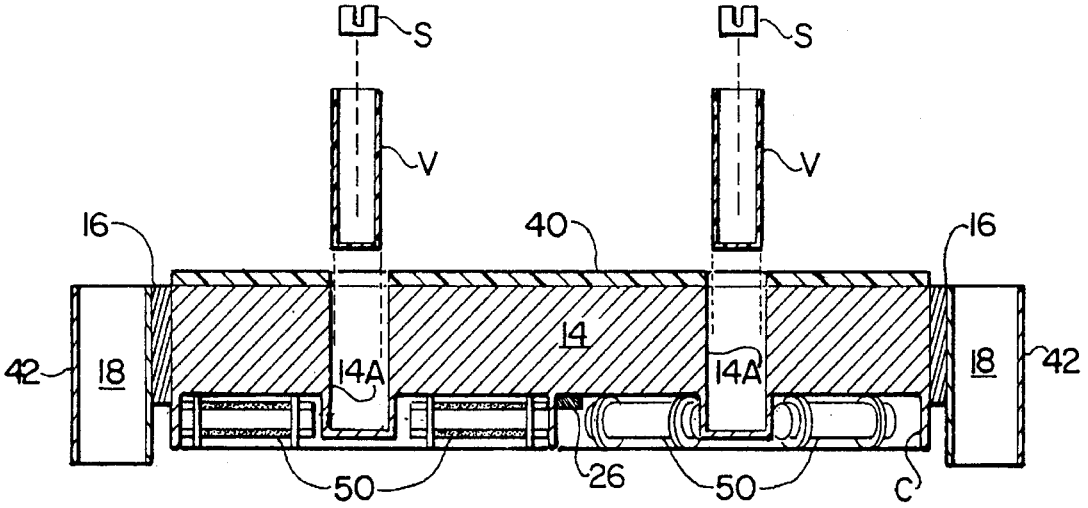
FIG. 3 is a cross-section view of the top portion of the apparatus taken along line 3—3 of FIG. 2.
Figure 4:
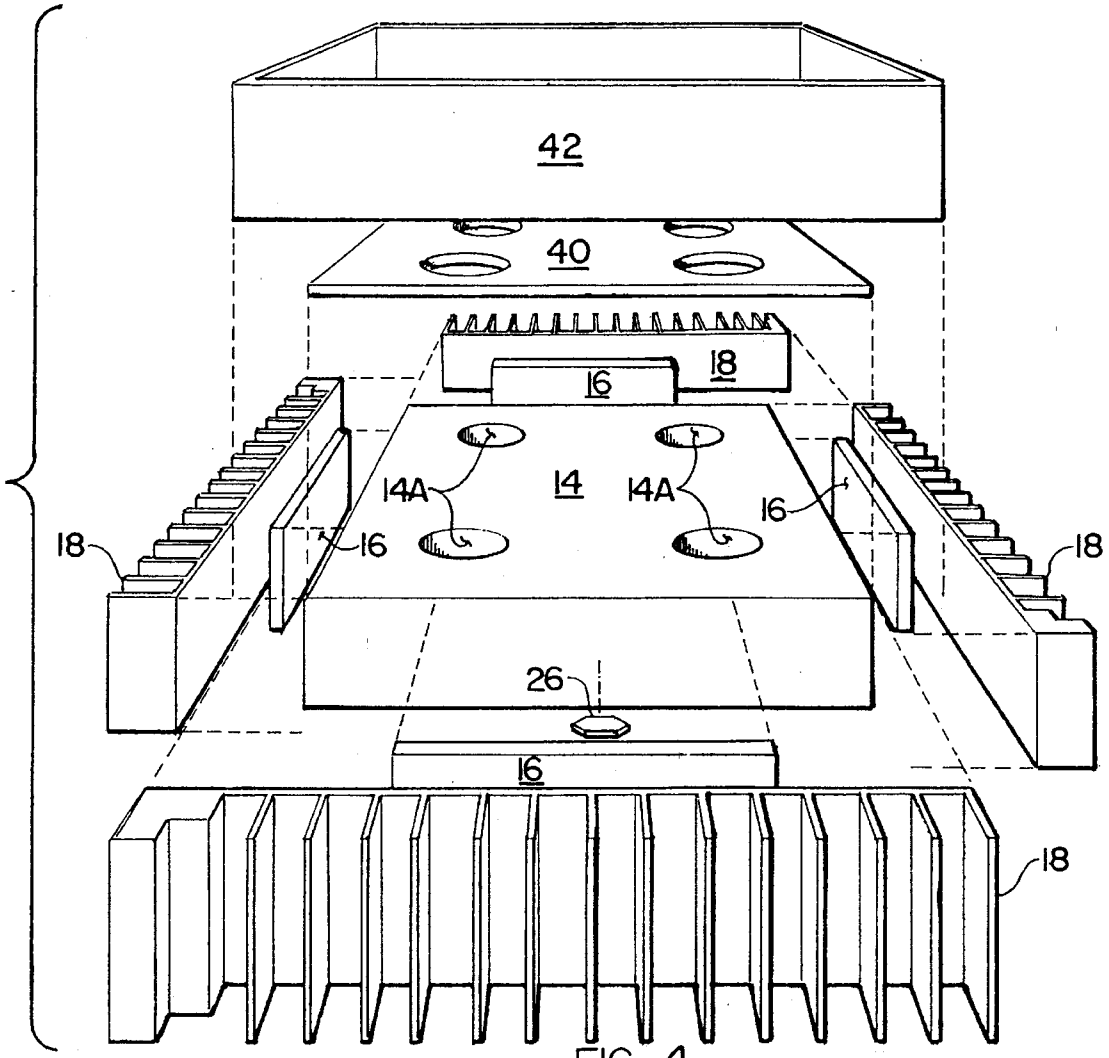
FIG. 4 is an exploded perspective view of the top portion of the apparatus shown in FIG. 3.
Figure 5:
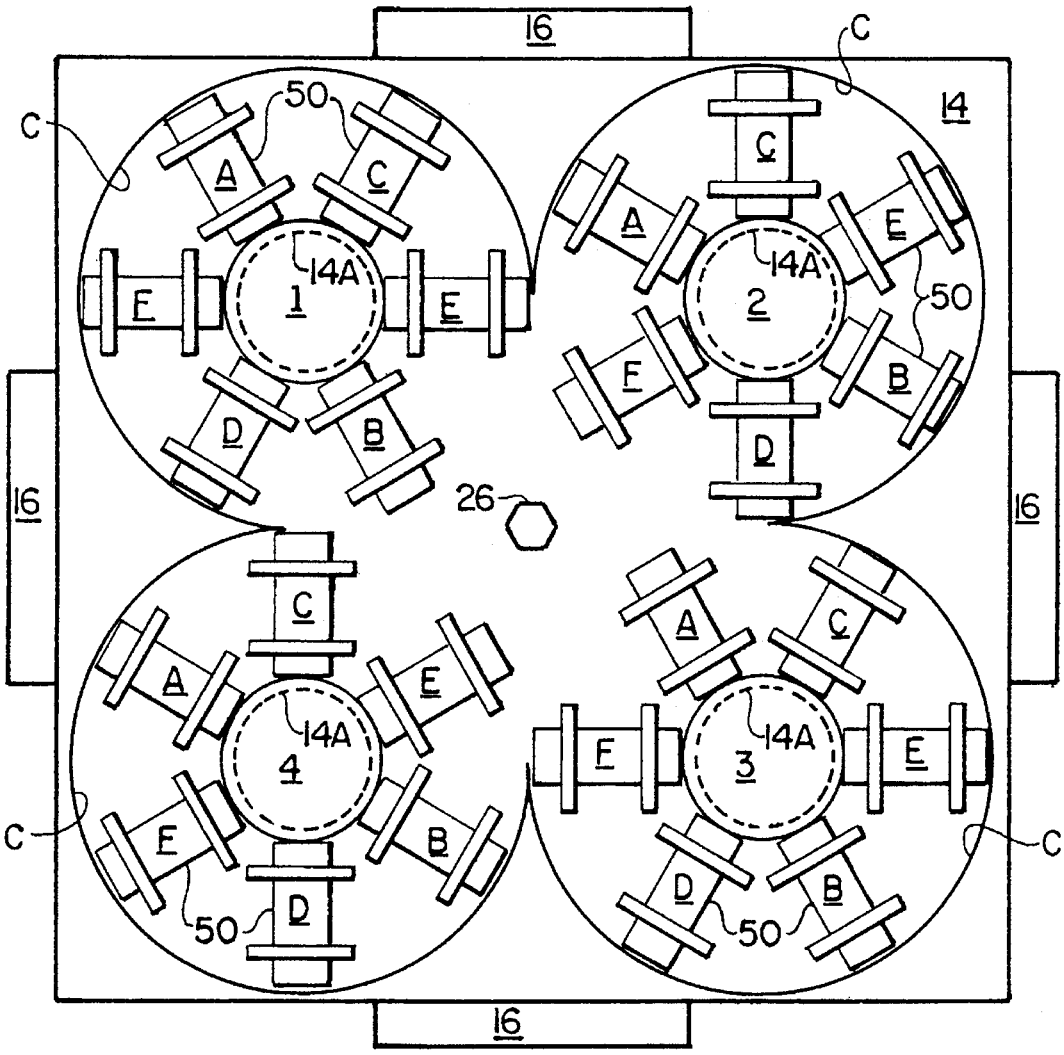
FIG. 5 is a bottom plan view of the top portion of the apparatus shown in FIG. 3.
Figure 6:
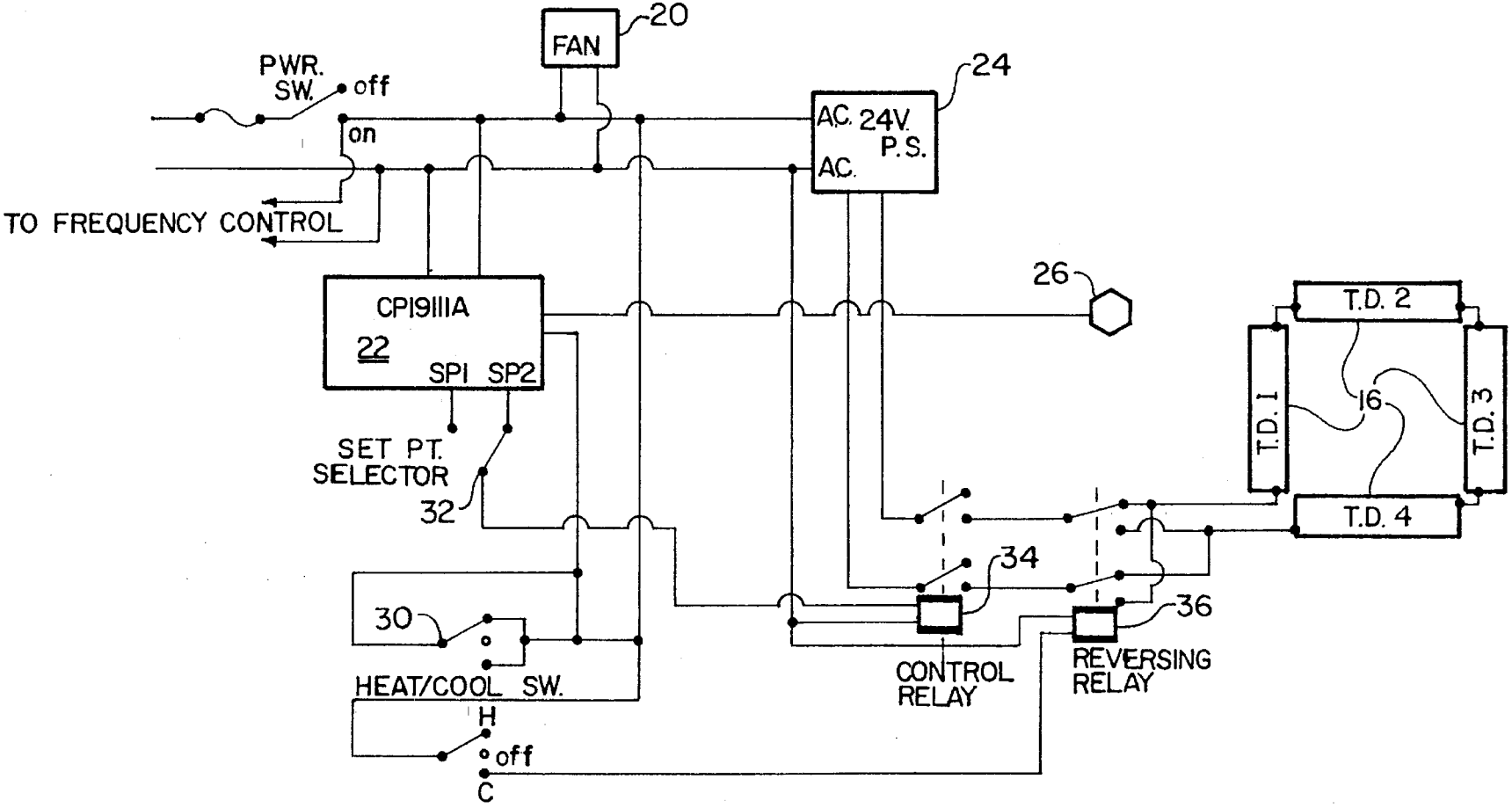
FIG. 6 is a simple schematic circuit diagram showing the circuitry for heating/cooling by the apparatus.

With particular reference now to FIGS. 2–4, it can be further appreciated that aluminum block 14 may be provided with a rubber insulating layer 40 over the top surface thereof and a frame 42 may be provided around the outer circumference of cooling fins 18 in the preferred embodiment of the invention as contemplated by applicants.

Referring now specifically to FIGS. 1–3, 5 and 7, the stirring mechanism of apparatus 10 will be described in detail. Beneath each of four wells 14A are six spaced-apart and radially extending coils 50 (see particularly FIGS. 3 and 5). Coils 50 are secured within annular cavities C which have been machined out of the bottom surface of aluminum block 14 around the circumference of the bottom of each well 14A. Thus, six coils 50 are secured in a spaced-apart and radially extending relationship around the circumference of each of the four wells 14A so as to be capable of inducing a magnetic field within each of wells 14A. When current is applied to each of the four sets of six coils, three individual dipole magnets are created by each of the four sets of six coils 50. A three phase frequency controller 52, most suitably a MITSUBISHI Part No. FRZ024-01K UL, is connected to coils 50 (see FIG. 7) such that the three individual dipole magnets surrounding each well 14A are energized wherein the polarity is sequentially cycled. This cycling applies a rotating but continuous magnetic field to the base of each well 14A so as to smoothly and continuously motivate magnetic stirrer S (see FIGS. 1 and 3) located at the bottom of vessel V therein.

Figure 7:
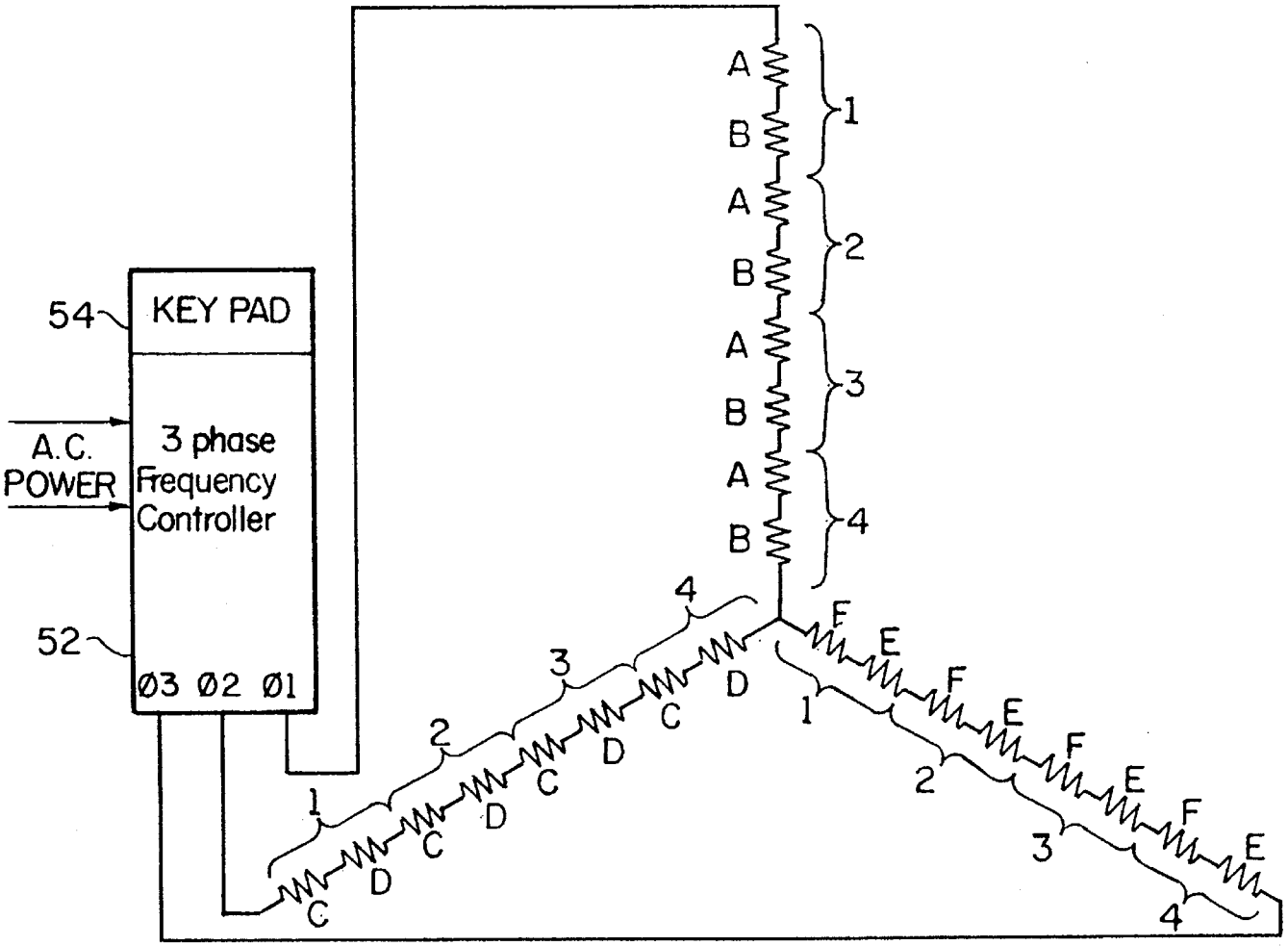
FIG. 7 is a simple schematic circuit diagram showing the circuitry for magnetic stirring by the apparatus.

The speed of three phase frequency controller 52 can be adjusted by means of key pad 54, most suitably a MITSUBISHI Part No. FRPUO1E, to between 0 RPM and 200 RPM. With reference to FIG. 7, it can be understood how three phase frequency controller 52 provides three out of phase currents to coils ABCDEF of each well 14A. The sequence can be described as follows.

Figure 8:
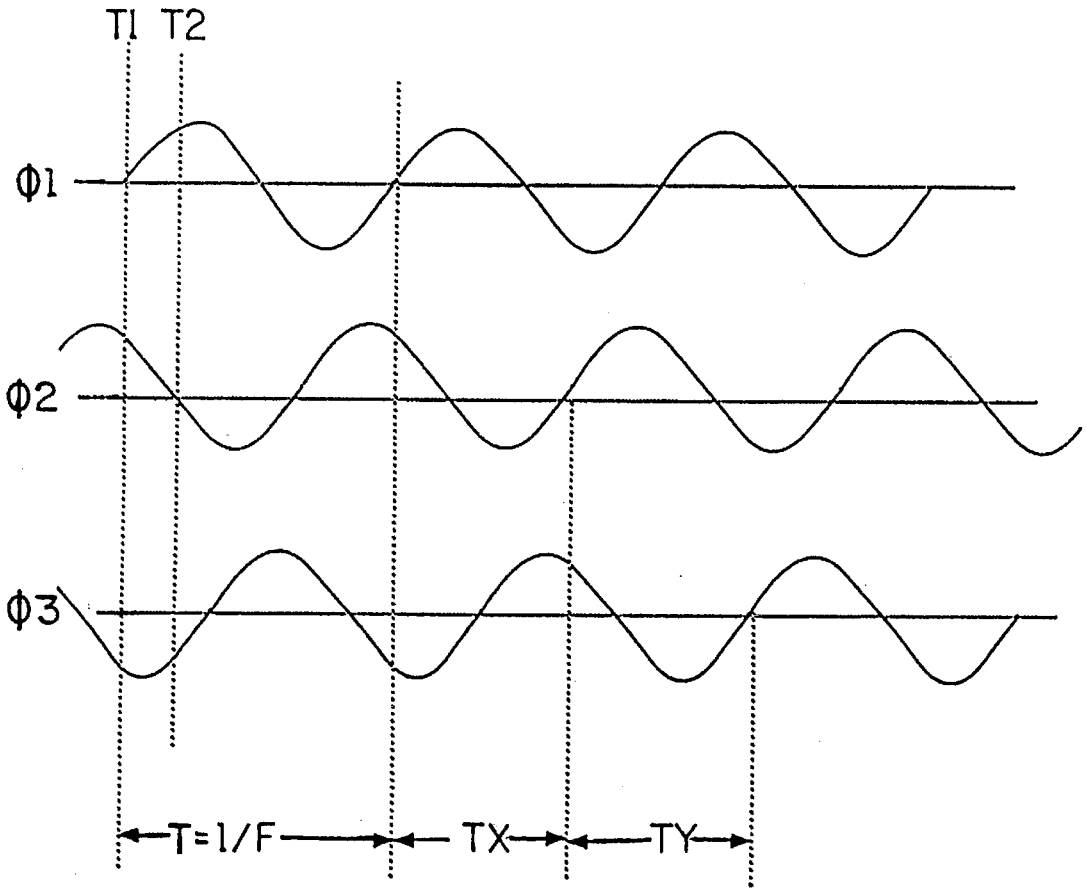
FIG. 8 is a diagram of the current outputs of the three phase frequency controller utilized by the apparatus.

Referring now to FIG. 8, the diagrams of current versus time for the three outputs of the three phase frequency controller, it can be seen that at time $T_1$ no current is flowing from ϕ1 while equal and opposite currents are flowing through ϕ2 and ϕ3. The resultant magnetic field is aligned between coils C, E and D, F (also see FIG. 5) and perpendicular to the axis through coils A and B. At time $T_2$, ϕ1has started to pass current through coils A and B, the current from ϕ2 has decreased, and the net remaining current flows out through ϕ3. The resultant magnetic field has moved towards alignment with coils E and F. The rate of charge of the currents is set such that the time T for one complete cycle is the inverse of the frequency selected. Further, the offset in time of the positive going zero crossing S ($T_x$, $T_y$) is fixed by the frequency controller at ⅔ T. It can be seen by examination of the current waveforms in FIG. 8 that at no time while the frequency controller is running is the current zero, and that the currents and the resultant magnetic field change smoothly over time.

In this fashion, unlike previous stepper motion magnetic fields, a continuous and overlapping magnetic field is applied to magnetic stirrer S within vessel V (see FIGS. 1 and 3) so as to smoothly and continuously turn the magnetic stirrer. The continuous motion provided to magnetic stirrer S as opposed to the discrete motions provided by a stepper motion magnetic field is particularly advantageous for many biological applications wherein simultaneous stirring and thermostating is desired with minimum agitation of the sample.

Figure 3A:
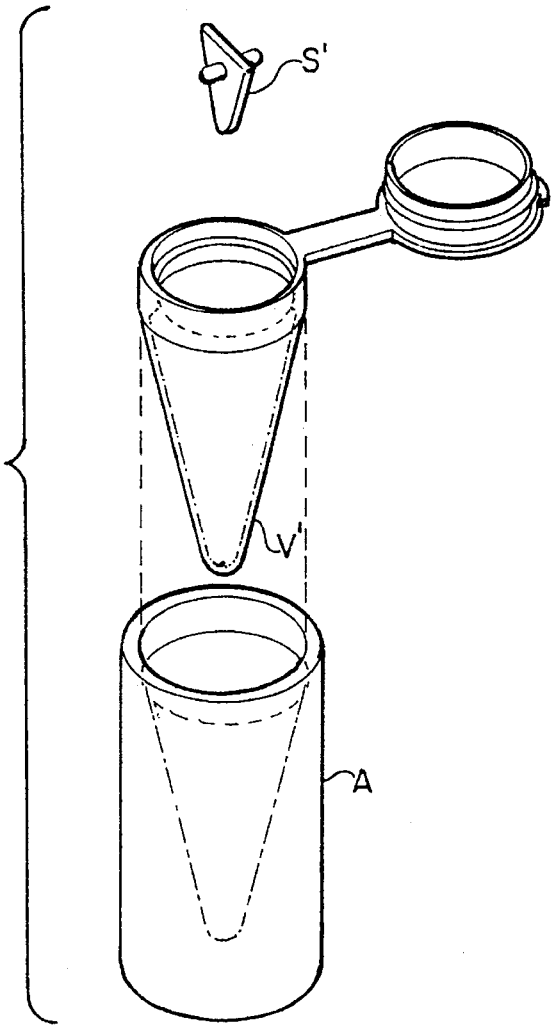
FIG. 3A is an exploded perspective view of a microcentrifuge tube and stirrer which can be used in the apparatus.

Apparatus 10 is believed by applicants to be particularly useful in any research or clinical laboratory setting requiring simultaneous stirring and thermostatic control of medium size biological samples (e.g., about 200 μl to 4 ml in size). Apparatus 10 provides for varying temperature from about 0° C. to about 40° C. and the stirring speed from between 0 RPM and 200 RPM. Apparatus 10 is ideally suited to accommodating spectrophotometric assays such as one by one centimeter optical cuvettes. However, the invention can be designed with wells 14A which accommodate sample vessels of substantially any shape and from as small as 0.5 centimeters in diameter to as much as several centimeters in diameter. For example, although optical cuvettes V and magnetic stirrers S are shown in FIGS. 1 and 3, apparatus 10 can accommodate EPPENDORF brand microcentrifuge tubes V' and magnetic stirrers S' as shown in FIG. 3A by use of adapter A.

Applicants have shown and described the preferred embodiment of apparatus 10 as an independent device herein, applicants contemplate that the invention also includes the combination of apparatus 10 with a spectrophotometer, spectrofluorometer and/or colorimeter instrument to control the temperature and stirring of cuvette samples being analyzed thereby.

It will be understood that various details of the invention may be changed without departing from the scope of the invention. Furthermore, the foregoing description is for the purpose of illustration only, and not for the purpose of limitation—the invention being defined by the claims.

What is claimed is:

1. A device adapted to magnetically stir and temperature control a plurality of liquid samples comprising:

(a) a plurality of vessels for containing the plurality of liquid samples to be stirred at a predetermined controlled temperature;

(b) a plurality of wells for supporting said plurality of vessels, and each of the wells having a bottom;

(c) power means for generating a plurality of continuously varying currents wherein said currents are in phase shifted relationship relative to each other;

(d) coil means electrically connected to said power means and positioned around each of said wells for establishing a rotating magnetic field in each of said wells in response to said plurality of continuously varying currents;

(e) a plurality of magnetic stir bars for positioning in said plurality of vessels supported within said corresponding plurality of wells and which are responsive to the rotating magnetic field within said wells so that the stir bars will rotate at a selected speed and stir the samples within said vessels;

(f) heating and cooling means thermoelectrically connected with said plurality of wells for heating and cooling said wells and said plurality of vessels supported in said wells; and (g) temperature control means electrically connected to said heating and cooling means for providing thermostatic temperature control to said vessels supported within said wells;

whereby simultaneous thermostatic heating and cooling and stirring of the plurality of liquid samples contained within said plurality of vessels can be accomplished.

2. A device according to claim 1 wherein said plurality of vessels comprises optical cuvettes.

3. A device according to claim 1 wherein said plurality of wells comprises 4 spaced-apart and vertically extending channels defined within a heat conductive metallic block.

4. A device according to claim 1 wherein said power means comprises a three phase A.C. power source.

5. A device according to claim 1 wherein said coil means comprises 6 coils positioned around the bottom of each well of said plurality of wells so as to form 3 dipole magnets when energized by said power means.

6. A device according to claim 1 wherein said heating and cooling means comprises a plurality of thermoelectric elements thermoelectrically connected with said plurality of wells.

7. A device according to claim 6 wherein said heating and cooling means further includes a thermocouple probe thermoelectrically connected with said plurality of wells.

8. A device according to claim 1 wherein the temperature controller means includes a controller for setting the temperature of the liquid samples in said plurality of vessels at a selected temperature between 0° C.–40° C.

9. A device according to claim 1 wherein the coil means includes a controller for establishing the magnetic field for setting the stirring speed of said stir bars in said plurality of vessels at a selected speed between 0 RPM–200 RPM.

10. A device adapted to magnetically stir liquid samples in a plurality of vessels with a corresponding plurality of magnetic stir bars and simultaneously temperature control the liquid samples, said device comprising:

(a) a plurality of wells for supporting the plurality of vessels, and each of the wells having a bottom;

(b) power means for generating a plurality of continuously varying currents wherein said currents are in phase shifted relationship relative to each other;

(c) coil means electrically connected to said power means and positioned around each of said wells for establishing a rotating magnetic field in each of said wells in response to said plurality of continuously varying currents to motivate the plurality of stir bars in the plurality of vessels so that the stir bars will rotate at a selected speed and stir the samples within said vessels;

(d) heating and cooling means thermoelectrically connected with said plurality of wells for heating and cooling said wells and the plurality of vessels supported in said wells; and (e) temperature control means electrically connected to said heating and cooling means for providing thermostatic temperature control to the vessels supported within said wells;

whereby simultaneous thermostatic heating and cooling and stirring of the plurality of liquid samples contained within the plurality of vessels can be accomplished.

11. A device according to claim 10 wherein said plurality of wells comprises 4 spaced-apart and vertically extending channels defined within a heat conductive metallic block.

12. A device according to claim 10 wherein said power means comprises a three phase A.C. power source.

13. A device according to claim 10 wherein said coil means comprises 6 coils positioned around the bottom of each well of said plurality of wells so as to form 3 dipole magnets when energized by said power means.

14. A device according to claim 10 wherein said heating and cooling means comprises a plurality of thermoelectric elements thermoelectrically connected with said plurality of wells.

15. A device according to claim 14 wherein said heating and cooling means further includes a thermocouple probe thermoelectrically connected with said plurality of wells.

16. A device according to claim 10 wherein the temperature controller means includes a controller for setting the temperature of the liquid samples in the plurality of vessels at a selected temperature between 0° C.–40° C.

17. A device according to claim 10 wherein the coil means includes a controller for establishing the magnetic field for setting the stirring speed of the stir bars in the plurality of vessels at a selected speed between 0 RPM–200 RPM.

* * * * *